US008206004B2

(12) United States Patent
Serak et al.

(10) Patent No.: US 8,206,004 B2
(45) Date of Patent: Jun. 26, 2012

(54) DISTRIBUTED LIGHTING APPARATUS

(75) Inventors: Christopher J. Serak, Burlington, WI (US); Gary J. Stabelfeldt, West Allis, WI (US)

(73) Assignee: American Fluorescent Corporation, Waukegan, IL (US)

( * ) Notice: Subject to any disclaimer, the term of this patent is extended or adjusted under 35 U.S.C. 154(b) by 455 days.

(21) Appl. No.: 12/498,963

(22) Filed: Jul. 7, 2009

(65) Prior Publication Data

US 2011/0005907 A1 Jan. 13, 2011

(51) Int. Cl.
*F21V 21/00* (2006.01)

(52) U.S. Cl. ..... 362/217.13; 362/217.1; 362/219; 362/222; 362/225

(58) Field of Classification Search ..... 362/147, 362/151, 217.01, 217.1, 217.11, 217.13, 362/219, 222, 225, 260
See application file for complete search history.

(56) References Cited

U.S. PATENT DOCUMENTS

| | | | | |
|---|---|---|---|---|
| 4,639,841 | A | 1/1987 | Salestrom et al. | |
| 5,226,724 | A | 7/1993 | Kanarek | |
| 5,251,118 | A | 10/1993 | Budnovitch et al. | |
| 5,733,037 | A | 3/1998 | Tennis et al. | |
| 6,563,049 | B2 | 5/2003 | May | |
| 6,984,055 | B2 | 1/2006 | McCarthy et al. | |
| 2004/0196651 | A1 | 10/2004 | Newbold | |
| 2007/0274067 | A1 * | 11/2007 | Sloan et al. | 362/219 |
| 2008/0094828 | A1 * | 4/2008 | Shao | 362/219 |
| 2009/0098764 | A1 * | 4/2009 | Janos et al. | 439/501 |

* cited by examiner

*Primary Examiner* — Stephen F Husar
*Assistant Examiner* — Meghan Dunwiddie
(74) *Attorney, Agent, or Firm* — Husch Blackwell LLP

(57) ABSTRACT

A user-configurable lighting apparatus is provided. One example incudes a hub, a supply power cord, a light fixture, a linking power cord, and a cord cover. The hub includes a housing comprising a plurality of cover receiving extensions, and each cover receiving extension has an electrical socket. The hub also includes an electrical plug electrically coupled to each electrical socket. The supply power cord has a plug end and a receptacle end. The plug end is adapted to connect to a conventional electrical outlet, and the receptacle end is adapted to fit into the electrical plug. The light fixture may include the components of a conventional fluorescent light fixture, and may further include a housing including a first and a second cover receiving extension. The first cover receiving extension has an electrical plug, and the second cover receiving extension has an electrical socket electrically connected to the electrical plug.

13 Claims, 8 Drawing Sheets

DISTRIBUTED LIGHTING APPARATUS

BACKGROUND

This invention generally relates to lighting systems and, more particularly, to lighting systems that have the appearance of permanently installed light fixtures, but are user-configurable and meet U.L. 153 requirements of portable lamps.

Known lighting systems for mounting on the ceiling of a room typically include hard-wired light fixtures and portable light fixtures. The hard-wired fixtures typically have the electrical distribution for the system installed as part of the wiring for the building in which the lighting system is installed. The light fixtures are placed where desired and an electrician custom fits wiring conduits and wiring to each fixture. Hard-wired fixtures have a neat, desirable appearance. However, once installed, altering the system, by moving a fixture or adding one or more fixtures or switches, would require an electrician to rearrange the wiring of the building.

Portable lamps may be safely installed by persons who are not licensed electricians. For ceiling-mounted lamps, portable lamps are typically installed by affixing the lamp to the ceiling or joist, and then plugging the lamp into an existing conventional outlet. In some instances, portable lamps may be daisy-chained. However, installing more than one portable lamp often results in undesirable and potentially unsafe dangling excess electrical cords. Also, the different portable lamps may not be able to be operated independently of one another.

What is necessary is a lighting system that meets U.L. 153, thereby allowing installation by a person other than an electrician, which is user-configurable and alterable, and yet still has a neat and desirable appearance, such as a hard-wired lighting system.

SUMMARY

A lighting apparatus according to one example of the present invention includes a hub, a supply power cord, a light fixture, a linking power cord, and a cord cover. The hub includes a housing comprising a plurality of cover receiving extensions, and each cover receiving extension has an electrical socket. The hub also includes an electrical plug electrically coupled to each electrical socket. The supply power cord has a plug end and a receptacle end. The plug end is adapted to connect to a conventional electrical outlet, and the receptacle end is adapted to fit into the electrical plug.

The light fixture of this example may include the components of a conventional fluorescent light fixture, and may further include a housing including a first and a second cover receiving extension. The first cover receiving extension has an electrical plug, and the second cover receiving extension has an electrical socket electrically connected to the electrical plug. The light fixture further includes a socket for receiving a lamp coupled to the electrical plug.

The linking power cord of this example has a predetermined length, and has a plug end and a receptacle end, where the plug end is adapted to fit into one of the electrical sockets, and the receptacle end adapted to fit into one of the electrical plugs. The elongated cord cover has a first end and a second end, and the cord cover is adapted to be trimmed to a desired length and to conceal the linking power cord. The first and second ends of the cord cover are also adapted to engage the cover receiving extensions of the hub and the light fixture. The cord cover may be rigid and straight, or may be flexible and curvable.

In another example, the lighting apparatus has a plurality of light fixtures, a plurality of linking power cords, and a plurality of cord covers.

In another example, each electrical outlet is substantially the same, and each electrical plug is substantially the same. In another example, the electrical plug of the hub is electrically coupled to each electrical socket by a switch, such as a conventional pull cord switch, a RF controlled switch, or a motion sensor controlled switch.

In another example, the lighting apparatus also includes a switch module. In this example, the switch module has a housing including a first and a second cover receiving extension. The first cover receiving extension has an electrical plug, and the second cover receiving extension has an electrical socket electrically coupled to the electrical plug by way of a switch.

In another example, the lighting apparatus also includes a coupler. The coupler has a plug side and a receptacle side, and the plug side is adapted to fit into one of the electrical sockets, and the receptacle side adapted to fit into one of the electrical plugs.

In another example, various components of a lighting apparatus are connected to each other. In this example, a hub has a housing comprising a plurality of cover receiving extensions, each cover receiving extension having an electrical socket. The hub also has an electrical plug electrically coupled to each electrical socket. A supply power cord, which has a plug end and a receptacle end, has the plug end connected to a conventional electrical outlet, and the receptacle end connected to the electrical plug of the hub. A first light fixture spaced is apart from the hub by a first distance. The light fixture has a housing comprising a first and a second cover receiving extension, the first cover receiving extension having an electrical plug, and the second cover receiving extension having an electrical socket electrically connected to the electrical plug. In this example, the light fixture also includes a lamp. A first linking power cord having a plug end and a receptacle end, the plug end is connected to a first electrical socket of the hub, and the receptacle end is connected to the electrical plug of the first light fixture. The first linking power cord has a predetermined length which is longer than the distance separating the light fixture from the hub. An elongated cord cover having a first end and a second end, the cord cover having been trimmed to a length to engage a first cover receiving extension of the hub and the first cover receiving extension the light fixture and to conceal the linking power cord, including a length of the linking power cord that exceeds the first distance.

The above example may be expanded to include a second light fixture spaced apart from the hub by a second distance, and a second linking power cord having a predetermined length longer than the second distance, where the plug end of the second linking power cord is connected to a second electrical socket of the hub, and the receptacle end is connected to the electrical plug of the second light fixture. In this example, a second elongated cord cover is trimmed to a length to engage a second cover receiving extension of the hub and a first cover receiving extension of the second light fixture, and to conceal the second linking power cord, including a length of the linking power cord that exceeds the second distance. Alternatively, the second light fixture may be coupled to the first light fixture. The lighting apparatus may be further expanded to include one or more switch modules and/or additional lighting fixtures. For example, a switch module may be disposed between the first and second light fixtures.

DETAILED DESCRIPTION

Figure 1:
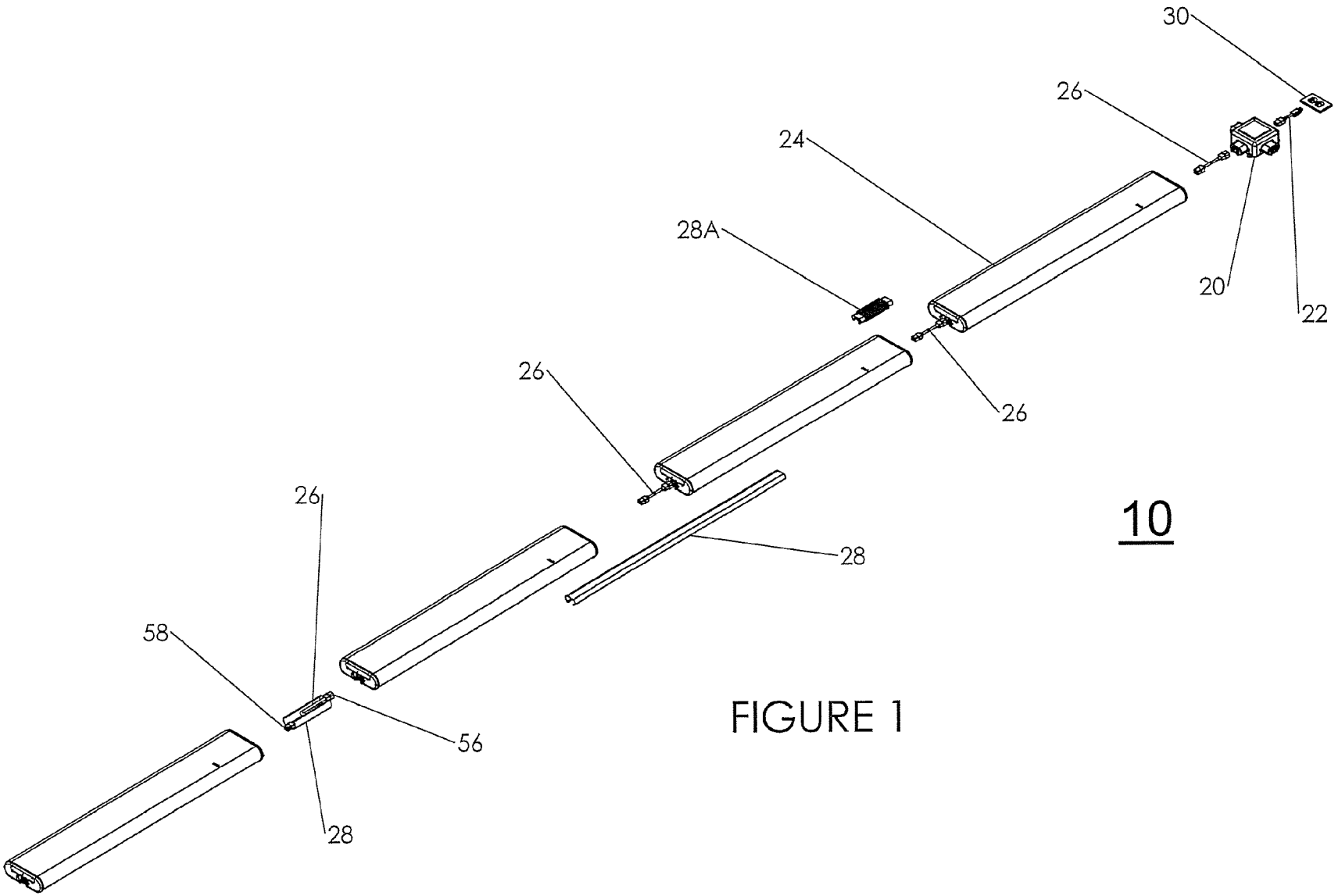
FIG. 1 is an illustration of an example one way to configure a lighting system according to the present invention.
Figure 2:
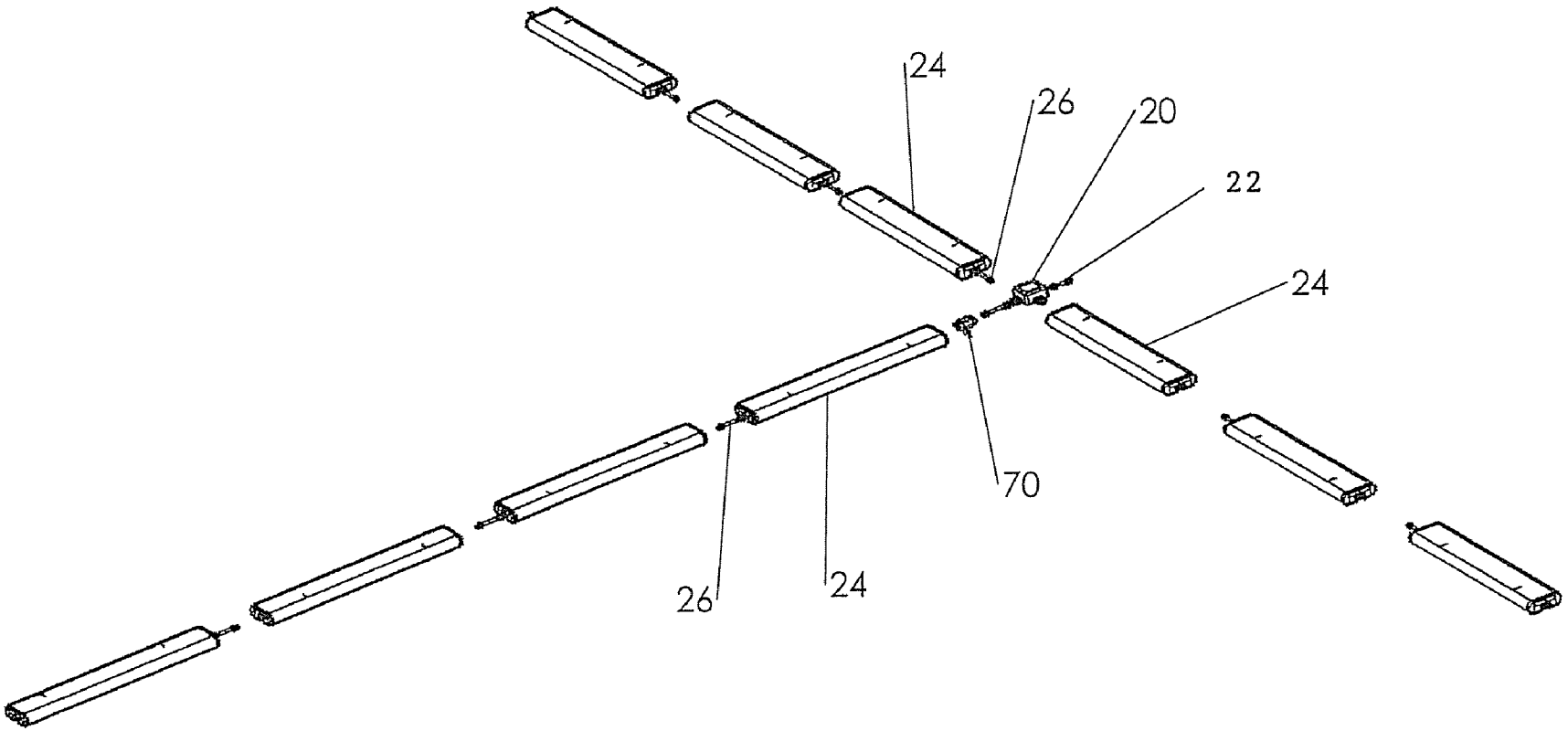
FIG. 2 is an illustration of an example another way to configure a lighting system according to the present invention.

Referring to FIGS. 1 and 2, a lighting system 10 according to one example of the present invention includes a number of components that may be connected in various configurations to provide the appearance of a permanent lighting installation, yet still comply with UL requirements for portable lamps. The lighting system 10 may include a hub 20, a power supply cord 22, one or more light fixtures 24, one or more linking power cords 26, and a one or more cord covers 28.

The hub 20 may be adapted to be fastened to the ceiling of a room near a conventional electrical outlet 30. The electrical outlet 30 may be unswitched, or may be operated by a wall switch (not shown). In another example, the hub 20 may be fastened directly to an electrical junction box. In this example, the hub 20 is adapted to be wired directly to the building wiring.

Figure 3:
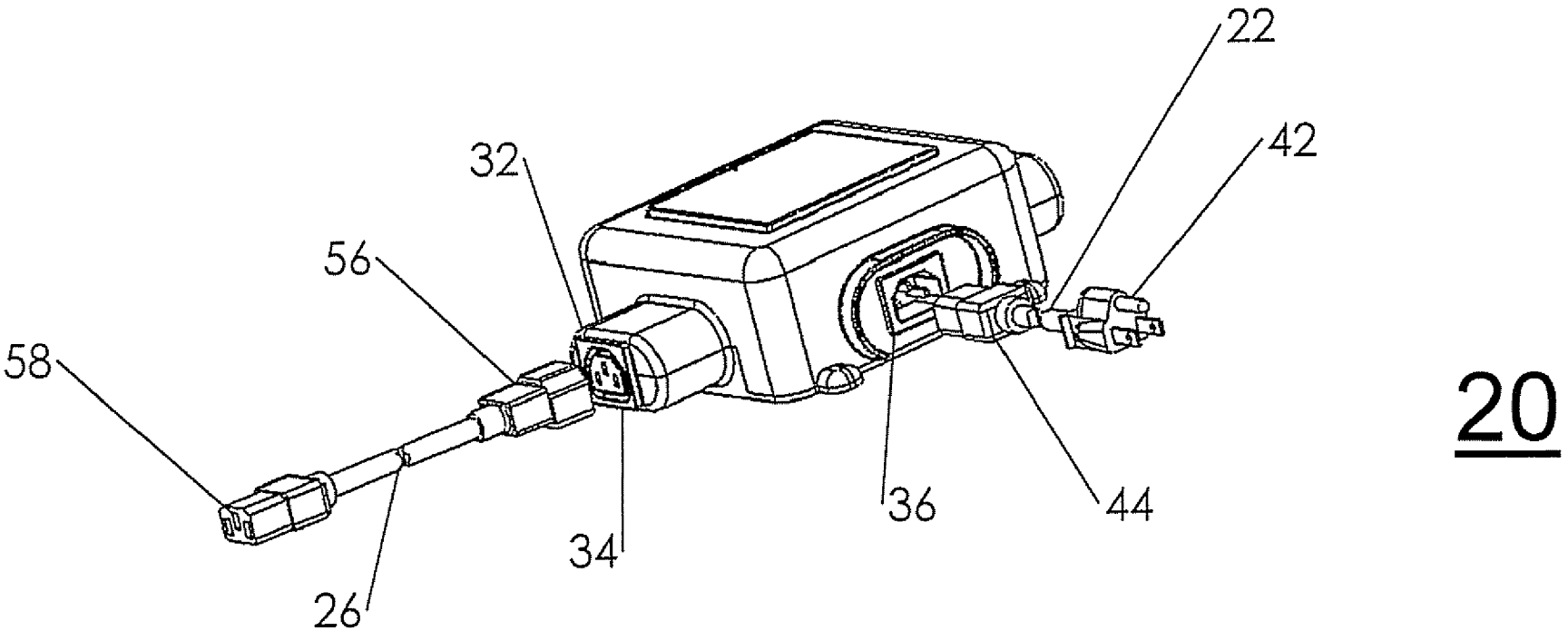
FIG. 3 is an illustration of one example of a hub according to the present invention.
Figure 4:
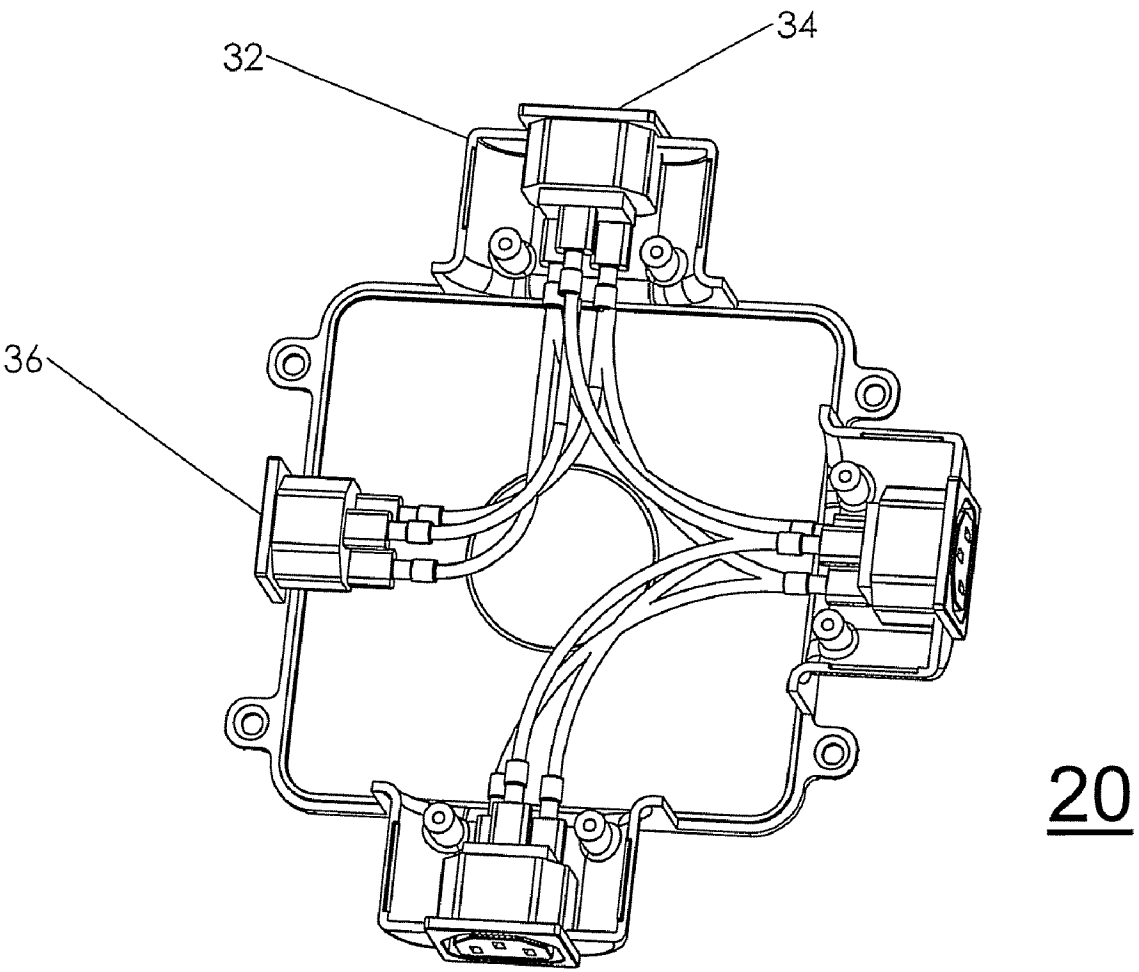
FIG. 4 is an illustration of the electrical characteristics of one example of a hub according to the present invention.
Figure 5:
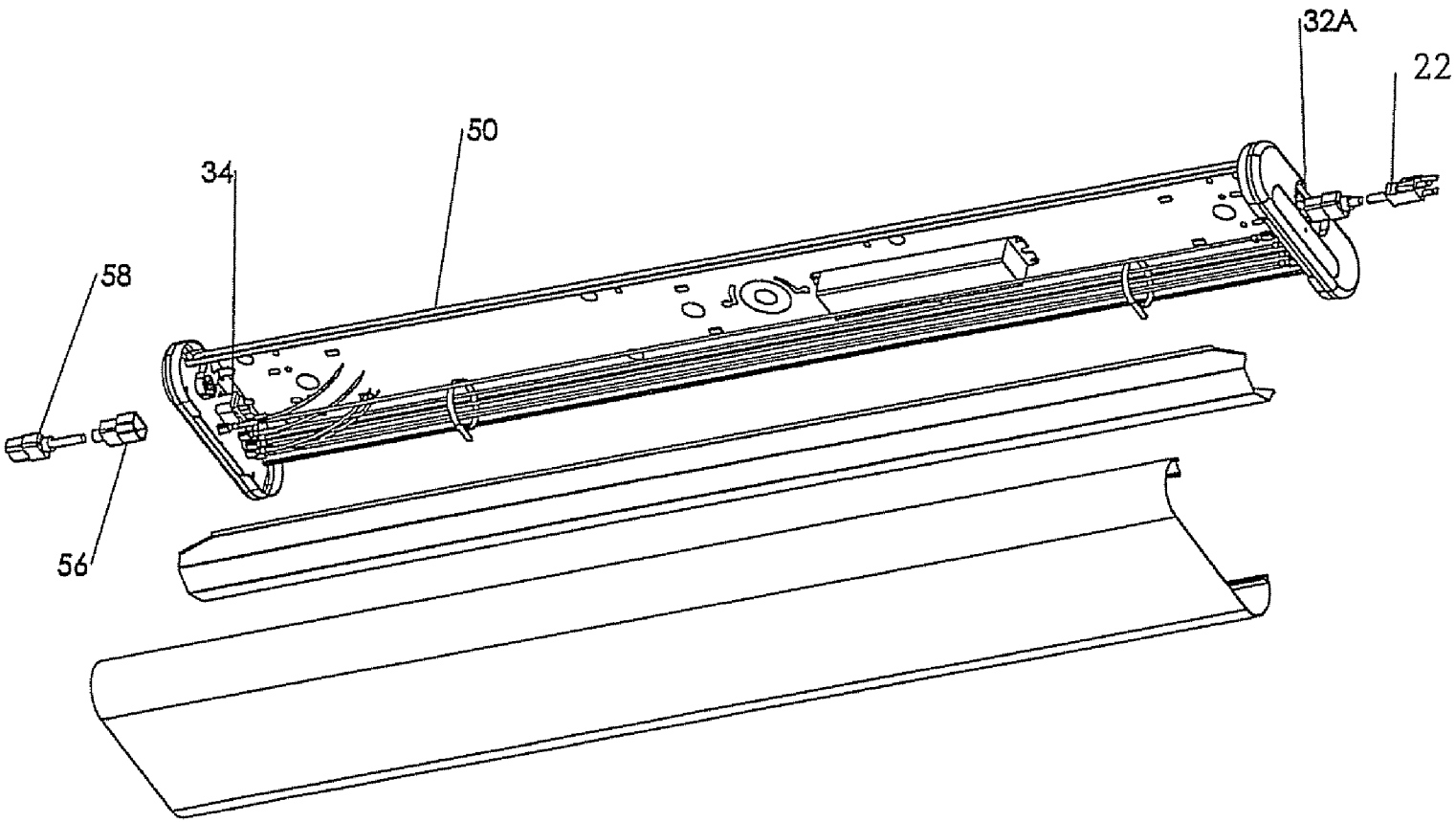
FIG. 5 is an illustration of one example of a light fixture according to the present invention.
Figure 6:
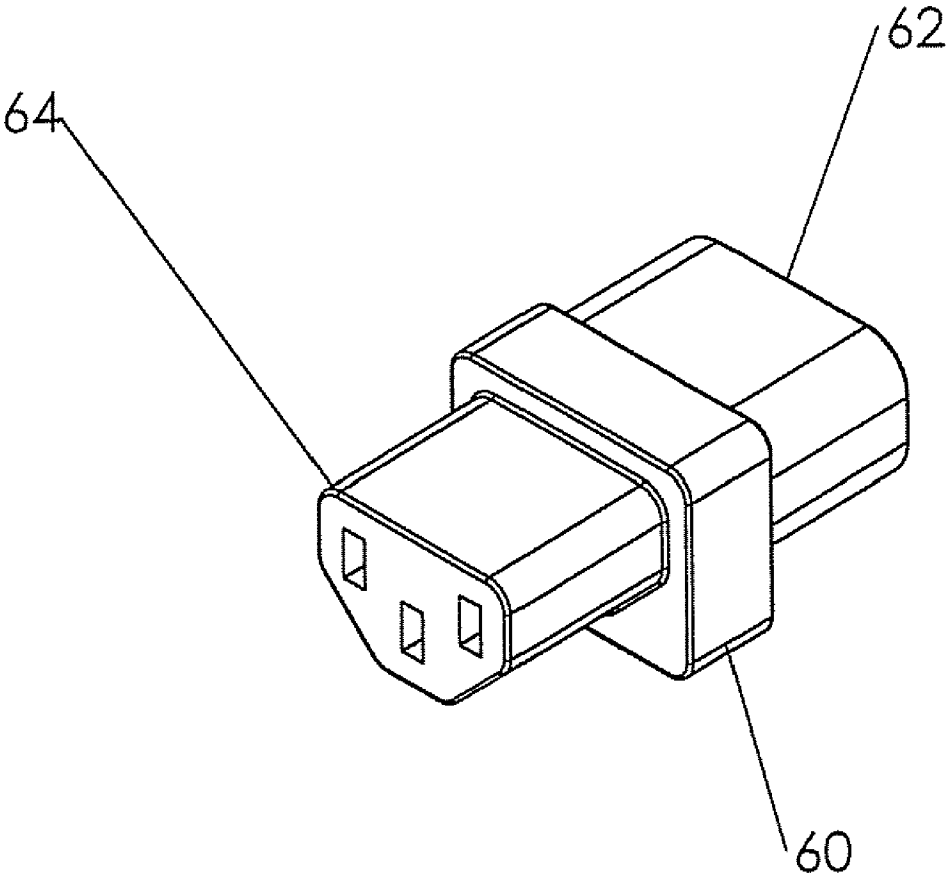
FIG. 6 is an illustration of one example of a coupler according to the present invention.
Figure 7:
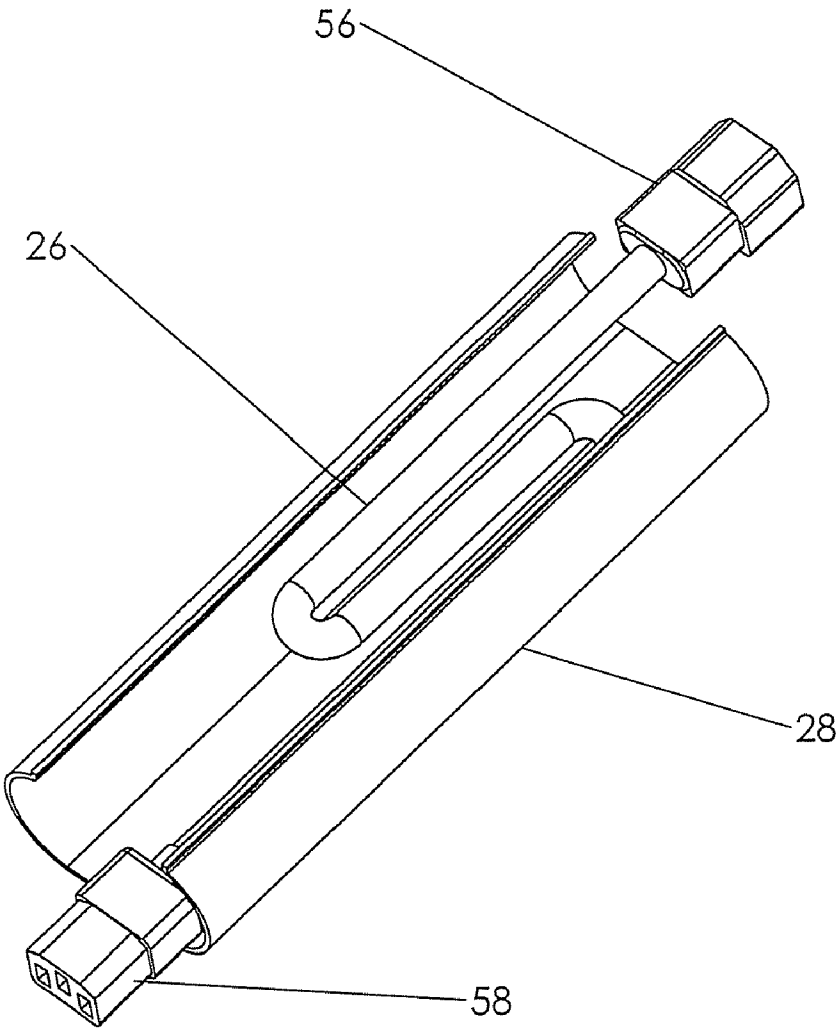
FIG. 7 is an illustration of certain aspects of a supply cord arrangement.

Referring to FIGS. 3 and 4, the hub 20 has a housing that includes a plurality of cover receiving extensions 32. The cover receiving extensions 32 may be oblong protrusions as shown in the illustrated example. In additional examples, the cover receiving extensions 32A may be of a different shape or may be recessed.

An electrical socket 34 may be located on each cover receiving extension 32. The hub also includes an electrical plug 36 that is electrically coupled to each electrical socket 34. In this regard, when the electrical plug 36 is connected to a source of electricity, it communicates the electricity to each of the electrical sockets.

In one example, the hub also includes a switch 38, which may be a remote control, radio frequency operated switch. This example allows the lighting system 10 to be switched on and off without changing the house wiring, even if the electrical outlet 30 is non-switched. In another example, the hub 20 may include a motion detector. In this example, switch 38 comprises a motion detector activated switch.

The power supply cord 22 couples the electrical plug 36 of the hub 20 to the electrical outlet 30. The power supply cord 22 includes a plug end 42 that is adapted to connect to the conventional electrical outlet 30 and the receptacle end 44 adapted to fit into the electrical plug 36. The electrical plug 36 and the receptacle end 44 may comprise with industry standard plugs and receptacles.

One or more light fixtures 24 may be installed in various configurations. Each light fixture 24 may include a housing 50 that supports a bulb for illuminating a room and associated wiring. For example, if the light fixture 24 is a fluorescent light fixture, the housing 50 would be adapted to support one or more fluorescent bulbs and a ballast appropriate to drive the bulbs. However, different lighting technologies would place different requirements on the housing 50. For example, an incandescent light bulb may not require a ballast and may be driven directly by household electrical current. In another example, a low voltage halogen bulb may require a transformer. The present invention may be practiced with any of these technologies, any other known lighting technology.

The housing 50 includes first and second cover receiving extensions 32. The cover receiving extensions may be of the same shape as the cover receiving extensions 32 on the hub 20. The first cover receiving extension 32 has an electrical plug 36, which may have the same dimensions as the electrical plug 36 of the hub. The second cover receiving extension 32 has an electrical socket 34, which may have the same dimensions as the electrical socket 34 of the hub 20. The electrical socket 34 is electrically connected to the electrical plug 36, typically by wires. The wires may have a connection between the electrical socket 34 and the electrical plug 36 to allow the bulb and/or supporting circuitry to be electrically connected to the household current.

The linking power cord 26 connects the hub 20 to the light fixture 24. The linking power cord 26 has a plug end 56 and a receptacle end 58. The plug end 56 is adapted to fit into one of the electrical sockets 34, and the receptacle end 58 is adapted to fit into one of the electrical plugs 36. Typically, the linking power cord 26 may be one of an assortment of a predetermined lengths. However, the linking power cord is not designed to be lengthened or shortened during installation of the lighting system 10. In this regard, the length of the linking power cord 26 is typically selected to be longer than the distance between components being connected by the linking power cord 26.

The linking power cord 26 may be used to connect a light fixture 24 to the hub 20, a light fixture 24 to another light fixture 24, or to link additional components of the lighting system 10 that are described below.

In another example, in the place of a linking cord 26, a coupler 60 may be provided. The coupler 60 has a plug side 62 and a receptacle side 64. The plug side 62 is adapted to fit into an electrical socket 34, and the receptacle side 64 is adapted to fit into an electrical plug 36. Using a coupler 60 in the place of a linking cord 26 allows components of the lighting system 10 to be placed in close proximity to each other.

The cord covers 28 may be elongated members having ends that are adapted to engage the cover receiving extensions 32 of the hub 20, the light fixture 24, or to link additional components of the lighting system 10 that are described below. In the illustrated example, the cord covers 28 are of a material that allows the cord covers 28 to be "snap-fit" onto the cover receiving extensions 32. The material may be a suitable plastic that allows for releasable engagement of the cover receiving extensions 32. In one example, the cord cover 28 is sufficiently rigid to allow for the cord cover to be installed over spans of up to 48" inches without support other than the engagement of the cover receiving extensions at either end of the cord cover 28. In another example, one or more mounting clips may be provided. In one example, two mounting clips are provided. The mounting clips may be anchored on the ceiling. The cord cover 28 may be snapped over the mounting clips to facilitate mounting the cord cover 28 flush with the ceiling. In another example, the cord cover 28A may have flexible portions to allow the cord cover 28A to be configured with turns, such as a 90 degree angle, or to compensate for installations that do not accurately align components of the lighting system 10.

In the illustrated example, the cord cover is of a substantially uniform cross section. This is to allow the cord cover 28 to be trimmed to a length that separates whatever components are being spanned by the cord cover 28, and yet still be adapted to engage the cover receiving extensions 32. Additionally, the illustrated example shows a cord covers that are hollow and of sufficient internal volume to allow any excess lengths of the linking power cord 26 to be gathered in the cord cover 28 and concealed from view. The cord covers 28 may be trimmed to an appropriate length without exposing any wiring, or modifying any portion of the lighting system 10 that conducts electricity. This enables a neat, custom installed appearance, any yet still maintain the standards for obtaining approval under the electrical standard for portable lamps.

Figure 8:
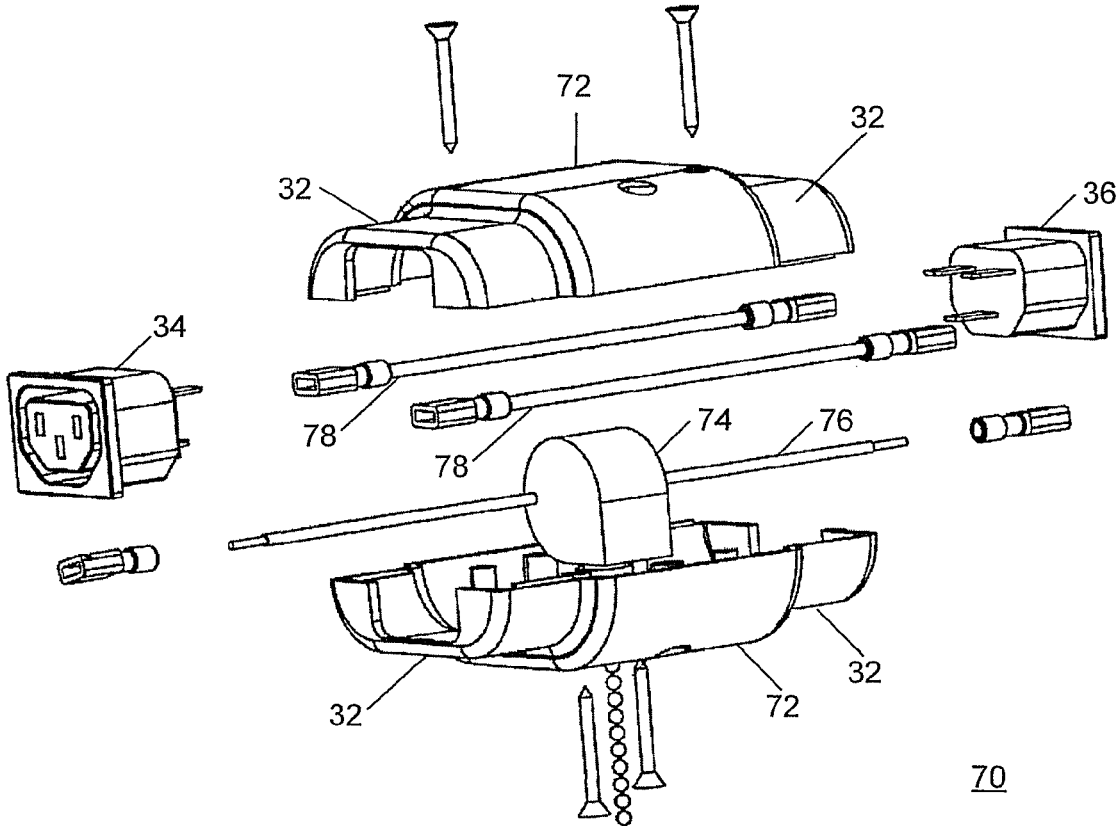
FIG. 8 is an exploded view of an example of a switch module.

The lighting system 10 in its most basic forms may be comprised of the components described above. However, the usefulness of the lighting system 10 may be enhanced with the optional use of additional components. For example, a switch module 70 may be provided. Referring to FIG. 8, the switch module 70 has a housing 72 that includes first and second cover receiving extensions 32. The first cover receiving extension 32 has an electrical plug 36, and the second cover receiving extension has an electrical socket 34 electrically coupled to the electrical plug by way of an electric switch 74 on jumper wire 76 and jumper wires 78. The switch 74 may be of a pull-cord configuration. The switch module 70 may be installed between the hub 20 and a light fixture 24, or between two light fixtures 24, or any other desirable location in the lighting system 10. The switch module 70 allows for switching a branch of the lighting system 10 to be switched off independently of any switch inside the hub 20, and allows for greater flexibility in the operation of the lighting system 10. Additionally, the inclusion of cover receiving extensions 32 and an electrical socket 34 and an electrical plug 36 allows for the use of the linking cords 26 to connect the switch module into the lighting system 10, and the cord covers 28 to conceal any excess length of the linking cords 26.

The above-described lighting system 10 provides for installation by persons other than trained electricians, yet has a neat appearance. The linking power cords 26 may be installed by a person other than trained electricians because the linking power cords are provided in predetermined lengths, and are not trimmed to the distance between components of the lighting system 10. The lighting system 10 maintains its neat appearance because the cord covers 28 may be trimmed to an appropriate length, and because the cord covers 28 conceal and safely support any excess length of the linking power cords 26. Additionally, the lighting system 10 may be readily modified or expanded due to the configuration of the hub 20, light fixtures 24, and other components, and because the wiring for the system is not installed as part of the building wiring.

What is claimed is:

1. A lighting apparatus, comprising:

a hub having a housing comprising a plurality of cover receiving extensions, each cover receiving extension having an electrical socket; the hub further comprising an electrical plug electrically coupled to each electrical socket;

a supply power cord having a plug end and a receptacle end, the plug end adapted to connect to a conventional electrical outlet, and the receptacle end adapted to fit into the electrical plug;

at least one light fixture having a housing comprising a first and a second cover receiving extension; the first cover receiving extension having an electrical plug, the second cover receiving extension having an electrical socket electrically connected to the electrical plug, the light fixture further comprising a socket for receiving a lamp coupled to the electrical plug;

a linking power cord having a plug end and a receptacle end, the plug end adapted to fit into one of the electrical sockets, and the receptacle end adapted to fit into one of the electrical plugs, the linking power cord having a predetermined length;

at least one elongated cord cover having a first end and a second end, the cord cover adapted to be trimmed to a desired length and to conceal the linking power cord, the first and second ends of the cord cover being adapted to engage the cover receiving extensions of the hub and the light fixture; and a switch module, the switch module having a housing comprising a first and a second cover receiving extension; the first cover receiving extension having an electrical plug, the second cover receiving extension having an electrical socket electrically coupled to the electrical plug by way of a switch.

2. The apparatus of claim 1, wherein each electrical outlet is substantially the same, and each electrical plug is substantially the same.

3. The apparatus of claim 1, further comprising a plurality of light fixtures, a plurality of linking power cords, and a plurality of cord covers.

4. The apparatus of claim 3, wherein at least one of the cord covers is flexible.

5. The apparatus of claim 1, wherein the light fixture further comprises a ballast, and the socket for receiving a lamp is coupled to the electrical plug by the ballast.

6. A lighting apparatus, comprising:

a hub having a housing comprising a plurality of cover receiving extensions, each cover receiving extension having an electrical socket; the hub further comprising an electrical plug electrically coupled to each electrical socket, wherein the electrical plug of the hub is electrically coupled to each electrical socket by a RF controlled switch;

a supply power cord having a plug end and a receptacle end, the plug end connected to a conventional electrical outlet, and the receptacle end connected to the electrical plug of the hub;

a first light fixture spaced apart from the hub by a first distance, the light fixture having a housing comprising a first and a second cover receiving extension; the first cover receiving extension having an electrical plug, the second cover receiving extension having an electrical socket electrically connected to the electrical plug, the light fixture further comprising a lamp;

a first linking power cord having a plug end and a receptacle end, the plug end connected to a first electrical socket of the hub, and the receptacle end connected to the electrical plug of the first light fixture, the first linking power cord having a predetermined length, the predetermined length being longer than the first distance; and first elongated cord cover having a first end and a second end, the cord cover trimmed to a length to engage a first cover receiving extension of the hub and the first cover receiving extension the light fixture and to conceal the linking power cord, including a length of the linking power cord that exceeds the first distance.

7. A lighting apparatus, comprising:

a hub having a housing comprising a plurality of cover receiving extensions, each cover receiving extension having an electrical socket; the hub further comprising an electrical plug electrically coupled to each electrical socket, wherein the electrical plug of the hub is electrically coupled to each electrical socket by a RF controlled switch;

a supply power cord having a plug end and a receptacle end, the plug end adapted to connect to a conventional electrical outlet, and the receptacle end adapted to fit into the electrical plug;

at least one light fixture having a housing comprising a first and a second cover receiving extension; the first cover receiving extension having an electrical plug, the second cover receiving extension having an electrical socket electrically connected to the electrical plug, the light fixture further comprising a socket for receiving a lamp coupled to the electrical plug;

a linking power cord having a plug end and a receptacle end, the plug end adapted to fit into one of the electrical sockets, and the receptacle end adapted to fit into one of the electrical plugs, the linking power cord having a predetermined length; and at least one elongated cord cover having a first end and a second end, the cord cover adapted to be trimmed to a desired length and to conceal the linking power cord, the first and second ends of the cord cover being adapted to engage the cover receiving extensions of the hub and the light fixture.

8. A lighting apparatus, comprising:

a hub having a housing comprising a plurality of cover receiving extensions, each cover receiving extension having an electrical socket; the hub further comprising an electrical plug electrically coupled to each electrical socket, wherein the electrical plug of the hub is electrically coupled to each electrical socket by a motion sensor activated switch;

a supply power cord having a plug end and a receptacle end, the plug end adapted to connect to a conventional electrical outlet, and the receptacle end adapted to fit into the electrical plug;

at least one light fixture having a housing comprising a first and a second cover receiving extension; the first cover receiving extension having an electrical plug, the second cover receiving extension having an electrical socket electrically connected to the electrical plug, the light fixture further comprising a socket for receiving a lamp coupled to the electrical plug;

a linking power cord having a plug end and a receptacle end, the plug end adapted to fit into one of the electrical sockets, and the receptacle end adapted to fit into one of the electrical plugs, the linking power cord having a predetermined length; and at least one elongated cord cover having a first end and a second end, the cord cover adapted to be trimmed to a desired length and to conceal the linking power cord, the first and second ends of the cord cover being adapted to engage the cover receiving extensions of the hub and the light fixture.

9. A lighting apparatus, comprising:

a hub having a housing comprising a plurality of cover receiving extensions, each cover receiving extension having an electrical socket; the hub further comprising an electrical plug electrically coupled to each electrical socket;

a supply power cord having a plug end and a receptacle end, the plug end adapted to connect to a conventional electrical outlet, and the receptacle end adapted to fit into the electrical plug;

at least one light fixture having a housing comprising a first and a second cover receiving extension; the first cover receiving extension having an electrical plug, the second cover receiving extension having an electrical socket electrically connected to the electrical plug, the light fixture further comprising a socket for receiving a lamp coupled to the electrical plug;

a linking power cord having a plug end and a receptacle end, the plug end adapted to fit into one of the electrical sockets, and the receptacle end adapted to fit into one of the electrical plugs, the linking power cord having a predetermined length;

at least one elongated cord cover having a first end and a second end, the cord cover adapted to be trimmed to a desired length and to conceal the linking power cord, the first and second ends of the cord cover being adapted to engage the cover receiving extensions of the hub and the light fixture; and a coupler, the coupler having a plug side and a receptacle side, the plug side adapted to fit into one of the electrical sockets, and the receptacle side adapted to fit into one of the electrical plugs.

10. A lighting apparatus, comprising:

a hub having a housing comprising a plurality of cover receiving extensions, each cover receiving extension having an electrical socket; the hub further comprising an electrical plug electrically coupled to each electrical socket;

a supply power cord having a plug end and a receptacle end, the plug end adapted to connect to a conventional electrical outlet, and the receptacle end adapted to fit into the electrical plug;

at least one light fixture having a housing comprising a first and a second cover receiving extension; the first cover receiving extension having an electrical plug, the second cover receiving extension having an electrical socket electrically connected to the electrical plug, the light fixture further comprising a socket for receiving a lamp coupled to the electrical plug;

a linking power cord having a plug end and a receptacle end, the plug end adapted to fit into one of the electrical sockets, and the receptacle end adapted to fit into one of the electrical plugs, the linking power cord having a predetermined length; and at least one elongated cord cover having a first end and a second end, the cord cover adapted to be trimmed to a desired length and to conceal the linking power cord, the first and second ends of the cord cover being adapted to engage the cover receiving extensions of the hub and the light fixture, wherein the cord cover is adapted to releasably engage the cover receiving extensions of the hub and the light fixture.

11. A lighting apparatus, comprising:

a hub having a housing comprising a plurality of cover receiving extensions, each cover receiving extension having an electrical socket; the hub further comprising an electrical plug electrically coupled to each electrical socket;

a supply power cord having a plug end and a receptacle end, the plug end connected to a conventional electrical outlet, and the receptacle end connected to the electrical plug of the hub;

a first light fixture spaced apart from the hub by a first distance, the light fixture having a housing comprising a first and a second cover receiving extension; the first cover receiving extension having an electrical plug, the second cover receiving extension having an electrical socket electrically connected to the electrical plug, the light fixture further comprising a lamp;

a first linking power cord having a plug end and a receptacle end, the plug end connected to a first electrical socket of the hub, and the receptacle end connected to the electrical plug of the first light fixture, the first linking power cord having a predetermined length, the predetermined length being longer than the first distance;

first elongated cord cover having a first end and a second end, the cord cover trimmed to a length to engage a first cover receiving extension of the hub and the first cover receiving extension the light fixture and to conceal the linking power cord, including a length of the linking power cord that exceeds the first distance;

a second light fixture spaced apart from the hub by a second distance, a second linking power cord having a predetermined length longer than the second distance, the plug end of the second linking power cord connected to a second electrical socket of the hub, and the receptacle end connected to the electrical plug of the second light fixture; and a second elongated cord cover having a first end and a second end, the second cord cover trimmed to a length to engage a second cover receiving extension of the hub and a first cover receiving extension of the second light fixture, and to conceal the second linking power cord, including a length of the linking power cord that exceeds the second distance.

12. A lighting apparatus, comprising:

a hub having a housing comprising a plurality of cover receiving extensions, each cover receiving extension having an electrical socket; the hub further comprising an electrical plug electrically coupled to each electrical socket;

a supply power cord having a plug end and a receptacle end, the plug end connected to a conventional electrical outlet, and the receptacle end connected to the electrical plug of the hub;

a first light fixture spaced apart from the hub by a first distance, the light fixture having a housing comprising a first and a second cover receiving extension; the first cover receiving extension having an electrical plug, the second cover receiving extension having an electrical socket electrically connected to the electrical plug, the light fixture further comprising a lamp;

a first linking power cord having a plug end and a receptacle end, the plug end connected to a first electrical socket of the hub, and the receptacle end connected to the electrical plug of the first light fixture, the first linking power cord having a predetermined length, the predetermined length being longer than the first distance;

first elongated cord cover having a first end and a second end, the cord cover trimmed to a length to engage a first cover receiving extension of the hub and the first cover receiving extension the light fixture and to conceal the linking power cord, including a length of the linking power cord that exceeds the first distance;

a second light fixture spaced apart from the first light fixture by a second distance;

a second linking power cord having a predetermined length longer than the second distance, the plug end of the second linking power cord connected to the electrical socket of the first light fixture, and the receptacle end connected to the electrical plug of the second light fixture; and a second elongated cord cover having a first end and a second end, the second cord cover trimmed to a length to engage a second cover receiving extension of the first light fixture and a first cover receiving extension of the second light fixture, and to conceal the second linking power cord, including a length of the linking power cord that exceeds the second distance.

13. A lighting apparatus, comprising:

a hub having a housing comprising a plurality of cover receiving extensions, each cover receiving extension having an electrical socket; the hub further comprising an electrical plug electrically coupled to each electrical socket;

a supply power cord having a plug end and a receptacle end, the plug end connected to a conventional electrical outlet, and the receptacle end connected to the electrical plug of the hub;

a first light fixture spaced apart from the hub by a first distance, the light fixture having a housing comprising a first and a second cover receiving extension; the first cover receiving extension having an electrical plug, the second cover receiving extension having an electrical socket electrically connected to the electrical plug, the light fixture further comprising a lamp;

a first linking power cord having a plug end and a receptacle end, the plug end connected to a first electrical socket of the hub, and the receptacle end connected to the electrical plug of the first light fixture, the first linking power cord having a predetermined length, the predetermined length being longer than the first distance;

first elongated cord cover having a first end and a second end, the cord cover trimmed to a length to engage a first cover receiving extension of the hub and the first cover receiving extension the light fixture and to conceal the linking power cord, including a length of the linking power cord that exceeds the first distance;

a switch module, the switch module having a housing comprising a first and a second cover receiving extension; the first cover receiving extension having an electrical plug, the second cover receiving extension having an electrical socket electrically coupled to the electrical plug by way of an switch, the switch module coupled to a second electrical outlet of the hub, a second light fixture spaced apart from the switch module by a second distance;

a second linking power cord having a predetermined length longer than the second distance, the plug end of the second linking power cord connected to the electrical socket of the switch module, and the receptacle end connected to the electrical plug of the second light fixture; and a second elongated cord cover having a first end and a second end, the cord cover trimmed to a length to engage the second cover receiving extension of the switch module and a first cover receiving extension of the second light fixture, and to conceal the second linking power cord, including a length of the linking power cord that exceeds the second distance.

* * * * *